US009181601B2

(12) United States Patent
Mafra et al.

(10) Patent No.: US 9,181,601 B2
(45) Date of Patent: Nov. 10, 2015

(54) PROCESS TO PRODUCE MANGANESE PELLETS FROM NON-CALCINATED MANGANESE ORE AND AGGLOMERATE OBTAINED BY THIS PROCESS

(75) Inventors: Washington Luiz Mafra, Guarapari (BR); João Batista Conti de Souza, Vitória (BR)

(73) Assignee: VALE S.A., Rio de Janeiro (BR)

( * ) Notice: Subject to any disclaimer, the term of this patent is extended or adjusted under 35 U.S.C. 154(b) by 1046 days.

(21) Appl. No.: 13/055,652

(22) PCT Filed: Jul. 27, 2009

(86) PCT No.: PCT/BR2009/000222

§ 371 (c)(1),
(2), (4) Date: Jan. 6, 2012

(87) PCT Pub. No.: WO2010/009527

PCT Pub. Date: Jan. 28, 2010

(65) Prior Publication Data

US 2012/0103134 A1 May 3, 2012

(30) Foreign Application Priority Data

Jul. 25, 2008 (BR) ..... 0804694

(51) Int. Cl.

| | |
|---|---|
| ***C22B 47/00*** | (2006.01) |
| ***C22B 1/242*** | (2006.01) |
| ***C22B 1/24*** | (2006.01) |

(52) U.S. Cl.

CPC ..... *C22B 1/2406* (2013.01); *C22B 1/242* (2013.01); *C22B 1/2413* (2013.01); *C22B 47/00* (2013.01); *C22B 47/0027* (2013.01); *C22B 47/0036* (2013.01)

(58) Field of Classification Search

CPC .... C22B 1/2406; C22B 1/2413; C22B 1/242; C22B 47/0027

See application file for complete search history.

(56) References Cited

U.S. PATENT DOCUMENTS

| | | | | |
|---|---|---|---|---|
| 2,986,461 | A * | 5/1961 | Menegoz et al. | 75/624 |
| 3,864,118 | A * | 2/1975 | Schumacher et al. | 75/10.67 |
| 3,942,974 | A | 3/1976 | Moreau et al. | |

(Continued)

FOREIGN PATENT DOCUMENTS

| | | | |
|---|---|---|---|
| GB | 1 164 744 | A | 9/1969 |
| JP | 74040765 | B * | 11/1974 |
| JP | 2002339010 | A * | 11/2002 |

OTHER PUBLICATIONS

Hino et al. JP 2002-339010A published Nov. 2002. Machine translation.*

(Continued)

*Primary Examiner* — George Wyszomierski
*Assistant Examiner* — Tima M McGuthry Banks
(74) *Attorney, Agent, or Firm* — Arent Fox LLP

(57) ABSTRACT

It is described a manganese pellet production from non-calcinated manganese ore, comprising the following phases: (a) ore size preparation through ore classification by function of particle size, smaller or equal to 1 mm particles being maintained from the ore particle fraction process so as to have a smaller or equal to 1 mm size, as well as the comminution of these particles; (b) flux addition; (c) agglomerant addition; (d) pelletizing resulting in crude pellets; and (e) thermal processing through crude pellet drying, pre-heating and heating.

13 Claims, 9 Drawing Sheets

(56) References Cited

Figure 1:
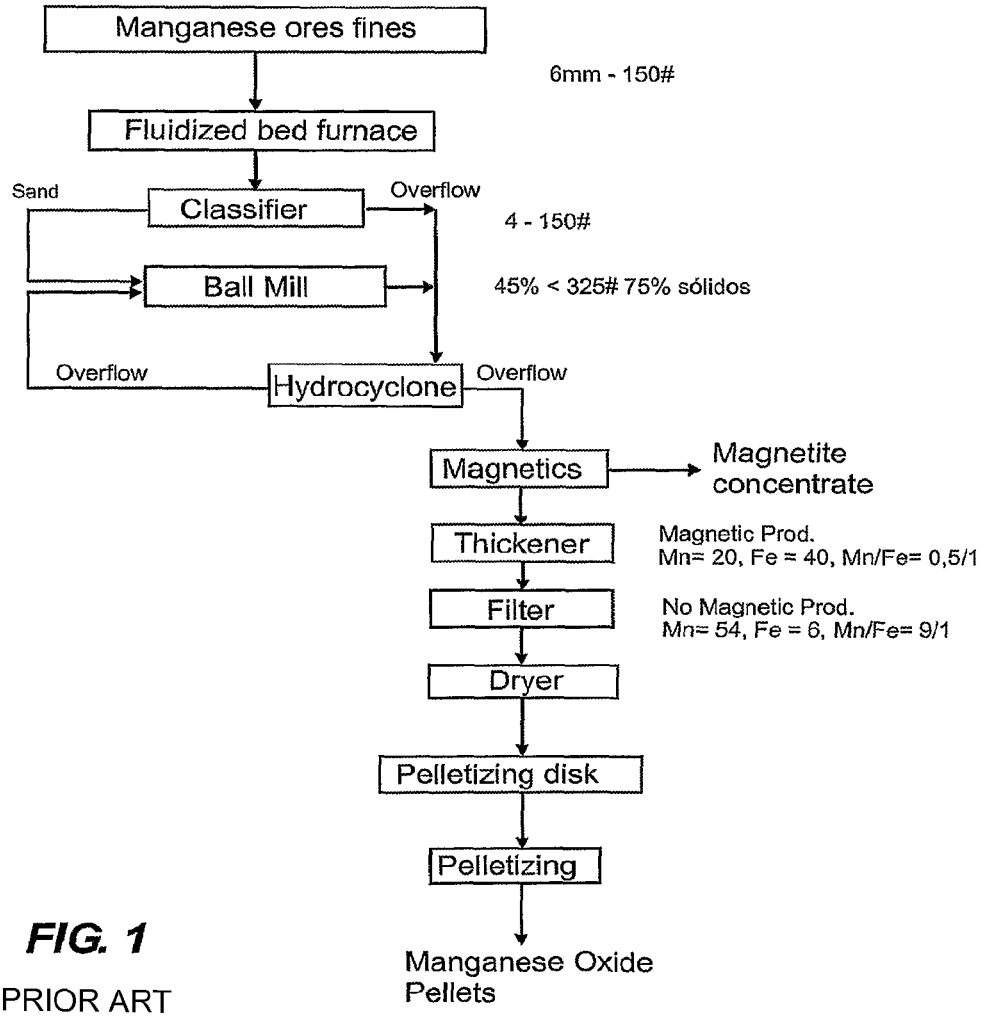
FIG. 1 PRIOR ART

U.S. PATENT DOCUMENTS 4,273,575 A * 6/1981 Litzinger et al. ..... 75/767
4,529,446 A * 7/1985 Valenti ..... 75/314
5,897,063 A * 4/1999 Patzelt et al. ..... 241/24.1
2006/0112786 A1 * 6/2006 Pammer et al. ..... 75/771

OTHER PUBLICATIONS

The International Search Report, mailing date of Oct. 23, 2009 (2 pages).

* cited by examiner

PROCESS TO PRODUCE MANGANESE PELLETS FROM NON-CALCINATED MANGANESE ORE AND AGGLOMERATE OBTAINED BY THIS PROCESS

CROSS-REFERENCE TO RELATED APPLICATION

This application is a National Stage entry of International Application No. PCT/BR2009/000222, filed Jul. 27, 2009, which claims priority to Brazilian Patent Application No. PI 0804694-8 filed Jul. 25, 2008, the disclosure of the prior application is incorporated in its entirety by reference.

APPLICATION FIELD

This is a manganese pellet production process, based on non-calcinated manganese ore. The invention-obtained product (manganese ore pellets) is used in ferroalloy production (Fe—Mn, Fe—Si—Mn) in electric furnaces, in Blast Furnace manganese high-grade pig iron and/or as alloy element in producing special steels.

STATE OF ART

Manganese has major importance in steelmaking. Approximately 90% of world manganese output is earmarked for steelmaking processes as ferroalloys.

Brazil holds manganese ore reserves in the states of Pará, Mato Grosso and Minas Gerais and these ores differ in their geologic formation.

Much fine is generated in ore extraction at the mines and in the manganese processing stations. Due to its grain size, such material has no direct use either in ferroalloy-making electric furnaces or in other furnaces. They are harmful to bed permeability, reducing plant productivity and increasing power consumption, in addition to environmental problems.

Manganese ore producers—especially those generating much fine—relentlessly pursue alternatives to increase the use of such ores. Among technological alternatives under consideration are fine agglomeration via sintering, pelletizing and briquetting.

The manganese sintering line is well established. This ore displays sintering-adequate behavior and produces appropriate sinter to be used in reduction electric furnaces—especially in local use—inasmuch as sinter lacks enough mechanical resistance to support excessive handling and long-distance hauling.

Some studies have been conducted in cold agglomeration via briquetting and pelletizing, but such studies have not been successful due to major problems in the physical and metallurgical quality of the agglomerates produced.

Hot manganese pellet-making has been studied before by companies and research centers. These studies showed that post-burn pellets are very brittle due to intensive crack generation. In all likelihood, this is due to much fire-caused loss of ore and to transformations in the manganese oxide phase. These facts have led to including preliminary phases in ore thermal processing in the production chain, aimed at making feasible the production of high physical quality Mn pellets.

The most common manganese pellet production process uses previously-calcinated manganese ore, in a fluidized bed reducing atmosphere. This process involves manganese ore thermal treatment following pelletizing and raw pellet burning. This thermal treatment, also known as reducing calcination, aims mainly at generating magnetite and at facilitating iron elimination through magnetic separation, leading to ore enrichment. A side effect of this thermal treatment is the decomposing of manganese superior oxides which interfere with manganese pellet burning in traditional production processes (Grate Kiln and Traveling Grate). Hence, the conventional manganese pellet production route includes, in addition to previous calcination in a fluidized furnace atmosphere, the phases of milling, filtering, magnetic separation, pelletizing and burning in Traveling Grate-type furnaces.

The technique's major hurdle to be overcome is the difficulty in obtaining physically-adequate manganese pellets, when they are produced from non-calcinated ore. In the process of burning manganese gross pellets obtained from non-calcinated ore, many defects occur in the pellet structure, such as cracks and fissures which significantly reduce resistance to compression. In extreme cases, this could lead to full pellet structural deterioration, a.k.a. spalling. Such phenomenon is due to excessive steam generation in the drying and preheating phases, caused by water evaporation and decomposition of manganese superior oxides. In cases wherein pellets have no adequate porosity, the steam generated creates internal tensions in the pellet structure which are sufficient to make it brittle or even destroy it. A physically inadequate pellet may generate excessive fines when handled, in hauling and/or during in-furnace reduction. This generation of fines may lead to product loss, if there is sieve screening prior to furnace or lead to poor material performance during reduction, due to loss of bed permeability.

Although important for steelmaking, production of manganese ore pellets has been little studied so far, and few papers have been published.

The document JP 001040426 deals with obtaining pellets from pre-reduced manganese ores.

The document UA 16847U deals with obtaining manganese iron from poor-quality manganese ores.

The document U.S. Pat. No. 4,273,575 deals with iron ore fines or manganese fines with particles under 150 microns, converted into spheres whose maximum size tops off at 6.0 mm, by adding agglomerants, followed by pelletizing and thermal treatment at 300° C.

The document JP 57085939 deals with raw material for iron-manganese production, entailing manganese ore fines undergoing addition of 7.0% of Portland-type cement agglomerant, and it may receive 7.0% to 10.0% water addition. Pellets are then cured at a time interval which can range from three days to one week.

ICOMI—Indústria e Comércio de Minérios do Amapá built and operated a pelletizing plant aimed at using manganese ore from its own mine. This plant was developed by the USA's Bethlehem Steel Corporation (BSC).

This plant's monthly production capacity was 20,000 tons.

Physical properties of manganese pellets can be compared to those obtained/known in iron ore pellets.

Plant management and operation were handled by ICOMI and technical assistance was provided by BSC.

Ore from Serra do Navio Mine (SNV) was a manganese oxide ore (65% weight) displaying the following formation:

| | | |
|---|---|---|
| Cryptomelane | $KMn_8O_{16}\bullet H_2O$ | Predominant component |
| Hausmanite | $Mn_3O_4$ | In lesser proportion |
| Alumina | Aluminum silicate | 20% |
| Iron ore oxide | FeO(OH) Goethite | 15% |

FIG. 1 shows the process flowchart for ore processing to feed the reducing calcination phase (Roaster) used by ICOMI.

Products from ICOMI's processing plant displayed the following features:

| | | | |
|---|---|---|---|
| Coarse | 75-13 mm | washed and sieve screened | 48.5% Mn |
| Gauged | 13-8 mm | washed and sieve screened | 48% Mn |
| Small | 8 mm-20 Mesh | Rake-type classifier | 43% Mn |
| Fine | 20-100 Mesh | hydrocyclone underflow | 31% Mn |
| Slimes | <100 Mesh | hydrocyclone overflow | 16% Mn |

For purposes of ICOMI pellet production, in the desired grain size, the system was a mix of 75 t small and 50 t fines, or 60% and 40% respectively. This mix (8 mm to 150 Mesh grain size) was then fed into the fluidized bed furnace (Roaster), which is used for calcination in a reducing atmosphere. The chief objective at this phase was to transform iron ore content from Hematite to Magnetite. Magnetite removal was made possible by magnetic separation. This increases the manganese/iron ratio, that is, it enriches the manganese ore. Furthermore, it has a side effect of calcinating the ore, which ensures that breakdown of superior Mn oxides does not occur during the pellet-burning process.

In order to pelletize the Mn ore—concentrated and calcinated—ICOMI used bentonite as agglomerating agent, adding 20 kilograms per ton of ore (2.0%). Resistance to compression by the pellets produced was in the order of 250 kgf per pellet.

Figure 2:
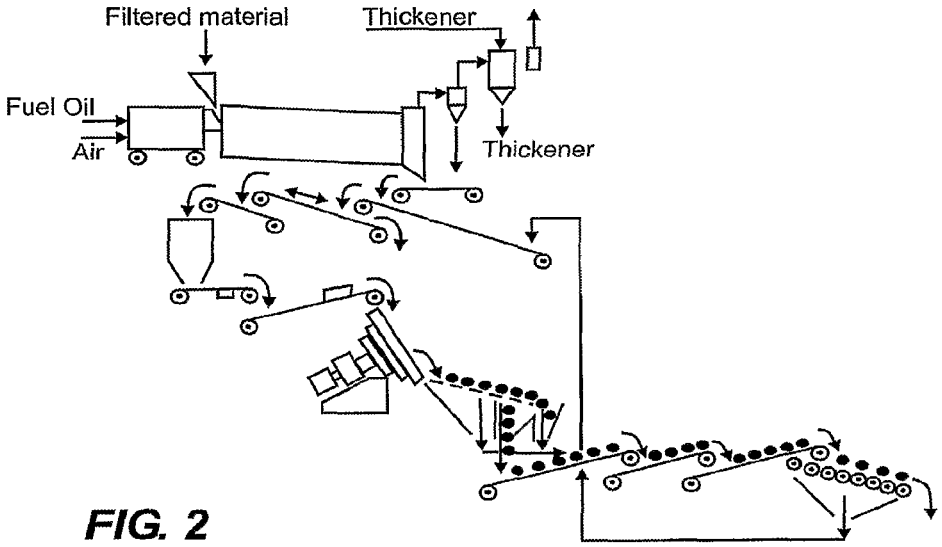
FIG. 2 PRIOR ART

FIG. 2 shows ore processing during reducing calcination up to pelletizing

The pelletizing disk was made with step-type levels, aimed at increasing resistance time of the material in the disk. This was conducive to better formation and superior finishing of crude pellets.

Figure 3:
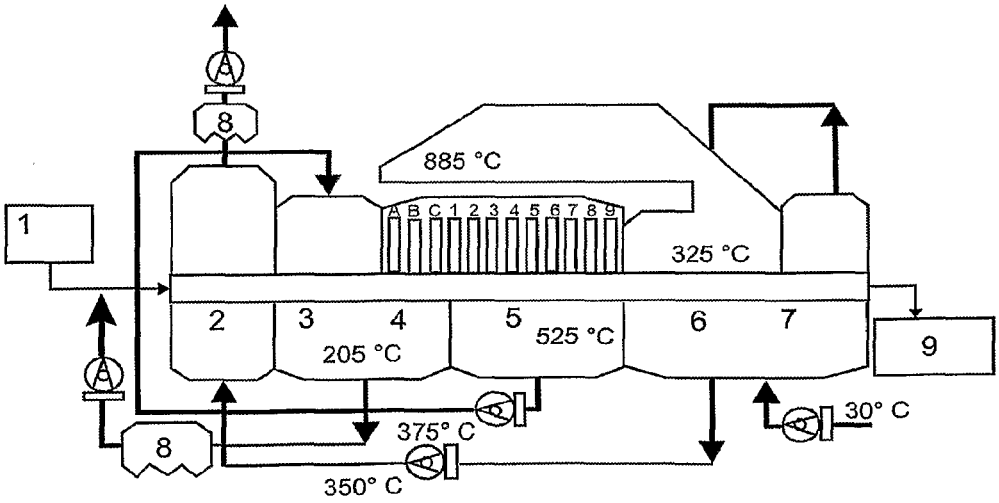
FIG. 3 PRIOR ART

FIG. 3 shows the schematic flow of crude pellet drying, pelletizing and screening.

Figure 4:
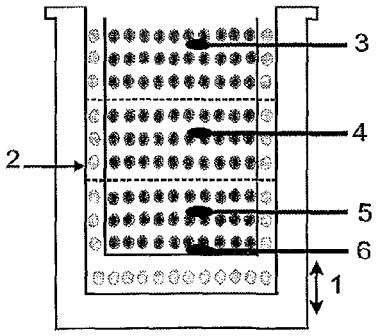
FIG. 4 PRIOR ART

A Traveling Grate-type furnace was used by ICOMI in the burn phase (see FIG. 4 drawing representing pelletizing burn furnace). FIG. 4 caption is in TABLE 1 herein below:

TABLE 1

FIG. 4 Caption

| Description | Caption |
|---|---|
| Crude pellets | (1) |
| Upwards drying | (2) |
| Downwards drying | (3) |
| Pre-burning | (4) |
| Burning | (5) |
| Post-burning | (6) |
| Cooling | (7) |
| PE | (8) |
| Burnt pellets | (9) |

TABLE 2 below indicates specification of ICOMI products:

TABLE 2

ICOMI Products's Specifications

| Product | Size (mm) | Chemical Breakdown (% weight) Mn | Fe | $SiO_2$ | $Al_2O_3$ | Mn/Fe | $K_2O + Na_2O$ | P | % < 6 mm |
|---|---|---|---|---|---|---|---|---|---|
| Coarse | 75-13 | 48.5 | 5.8 | 2.5 | 5.2 | 8/1 | 2.0 | 0.09 | 15 |
| Gauged | 13-8 | 48.0 | 6.0 | 2.0 | 5.0 | 8/1 | — | — | — |
| Small | 8-20# | 43.0 | 8.0 | 5.0 | 7.0 | 5/1 | 1.5 | 0.10 | 100 |
| Fines | 20#-100# | 31.0 | 10.0 | 14.0 | 12.0 | 3/1 | — | — | — |
| Slimes | <100# | 16.0 | 14.0 | 25.0 | 30.0 | 1/1 | — | — | — |
| Pellet | 20-6 | 55.1 | 6.1 | 5.2 | 7.2 | 9/1 | 1.1 | 0.09 | 10 |

In summary, ICOMI's pelletizing process demands a reducing calcination phase, followed by magnetic separation as an alternative to increase the Mn/Fe ratio in the ore, making it possible to reduce the degradation effect brought about by the chemical processing of pellets. Following this phase, the ore underwent wet milling, was classified by hydrocyclones, subject to thickening, homogenizing, filtering and ore drying, prior to its pelletizing phase.

OBJECTIVES OF THE INVENTION

It is an objective of this invention to produce pellets with manganese ore fines, eliminating previous ore calcination and replacing the phases of milling, thickening, homogenizing, filtering and drying with natural roller press comminution.

The product obtained has pre-defined chemical breakdown and physical features, such as high resistance to compression and to wearing (abrasion), in order to withstand load-and-unload handling, long distance hauling and processing in steelmaking furnaces.

This invention downplays the catastrophic effect of pellet degradation, through:

- adequate control of ore grain-size distribution;
- knowledge of transformation mechanisms phases, thus increasing the temperature the ore is subject to (vide Table 3);
- elaboration of an adequate thermal cycle for purposes of controlling the burning phase.

TABLE 3

Temperature-dictated manganese ore reactions

| TEMPERATURES | REACTIONS |
|---|---|
| 560-630° C. | $4\ MnO_2$ (c) at $2\ Mn_2O_3$ (c) + $O_2$ stable Pirolusite Criptomelane Reaction |
| 840-900° C. | $2\ KMn_8O_{16}$ (c) at $6\ Mn_2O_3$ (c) + $3\ O_2$ + $K_2Mn_4O_8$ (c) Criptomelane Partridgeit Potassium Permanganate |
| 900-1020° C. | $3\ Mn_2O_3$ (c) at $2\ MnO \bullet Mn_2O_3$ (c) + ½ $O_2$ Hausmanite Partridgeit |
| | $2\ K_2Mn_4O_8$ (c) at $4\ Mn_2O_3$ (c) + $O_2$ + $2K_2O$ (liq) Potassium Permanganate |
| | $2\ K_2O$ (liq) + $Al_2O_3$ (c) + $2\ SiO_2$ (c) at $2\ KAlSiO_4$ (c) + $2\ O_2$ |

ADVANTAGES OF THE INVENTION

A new process was developed to obtain manganese pellets from previously non-calcinated ore. This process has some advantages, among them:

- to allow the obtention of a product with pre-set/known chemical breakdown; greater mass balance precision;

to allow a reduction/elimination of heavy elements through their recovery via gas processing system;

to allow the obtention of manganese pellets displaying adequate mechanical resistance to withstand long-distance hauling, handling and degradation during its use in metallurgic reactors, generating less fines in all these phases;

significantly reduced operating cost vis-à-vis conventional process cost;

to allow the improvement of metallurgical reactors performance. Increased productivity of alloy iron furnaces by function of a more homogeneous particle size and better load permeability;

to allow the obtention of a more homogenous product in terms of chemical composition, physical and metallurgical qualities of its components—production of loads aimed at the fabrication of alloy irons, pig iron or as added element for the fabrication of special steels;

to allow the reuse of fines generated during extraction, handling/beneficiation and transportations—maximization of reserves;

to allow the reduction of environmental liabilities;

to allow the recovery of dam-related materials—reuse of tailings. Turn fine ore considered waste into reserves;

to allow the treatment of residues at their very generating source, thereby reducing environmental liabilities as well as fabrication costs as a result of reduced raw material cost by virtue of their decreased value and that of obtained substitution ratios;

to allow the anticipation of solutions in the case of more severe environmental restrictions in Europe;

to allow a lower moisture grade product, thus reducing freight costs with a metallic-richer product;

to allow the introduction of a new and higher aggregate value product in the market;

SUMMARIZED DESCRIPTION OF THE INVENTION

Manganese agglomerates showing improved mechanical strength were developed, as well as their respective production processes through comminuted manganese ore agglomeration with no previous calcination, using hot pelletizing, comprising the following phases:

(a) ore size preparation through ore classification by function of particle size, smaller or equal to 1 mm particles being maintained from the ore particle fraction process so as to have a smaller or equal to 1 mm size, as well as the comminution of these particles;

(b) addition of flux;

(c) addition of agglomerant;

(d) pelletizing resulting in crude pellets; and (e) thermal processing through drying, pre-heating and crude pellet heating.

SUMMARIZED DESCRIPTION OF THE DRAWINGS

Figure 5:
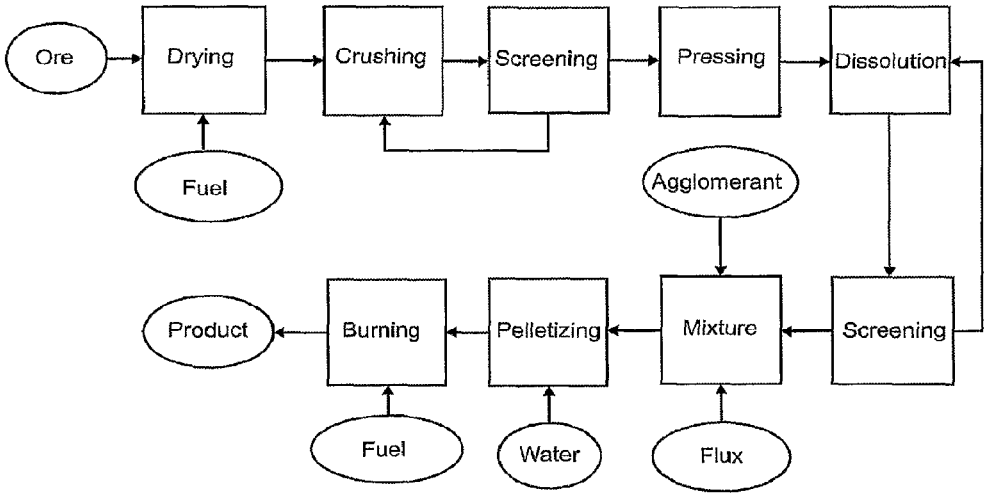
Figure 6:
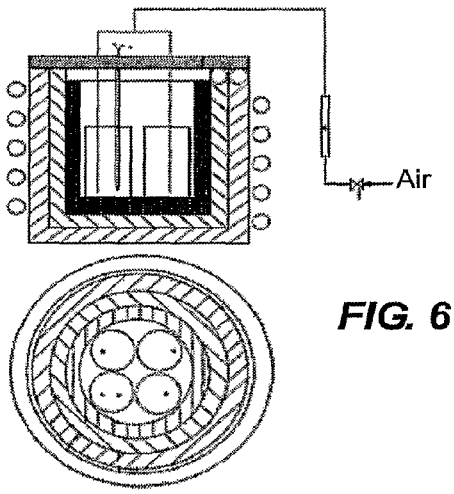

An elaborate description of this present invention is presented hereinafter based on an execution example depicted by drawings. Pictures and photos show:

FIG. 1—shows ore treatment process flowchart for the reducing calcination phase feed (Roaster) used in the prior art;

FIG. 2—shows ore processing during the reducing calcination phase down to the pelletizing known in the state of art;

FIG. 3—shows the schematic flowchart drying phase, pelletizing and screening of the crude pellets known in the state of art;

FIG. 4—shows a Straight-type furnace—Grade Induration Machine known to the state of the technique;

FIG. 5—shows a flowchart containing the mixture compound for pelletizing and the process ore route preparation, object of this invention;

FIG. 6—shows a Pot-Grate burning furnace's schematic drawing used in the simulated travelling grate-type process.

Figure 7:
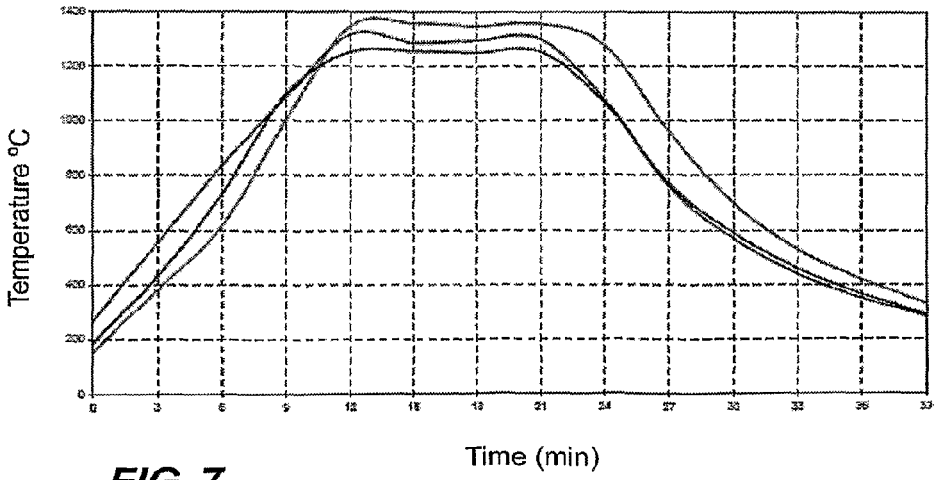

FIG. 7—shows an induction furnace used in the simulated "steel belt" process.

Figure 8A:
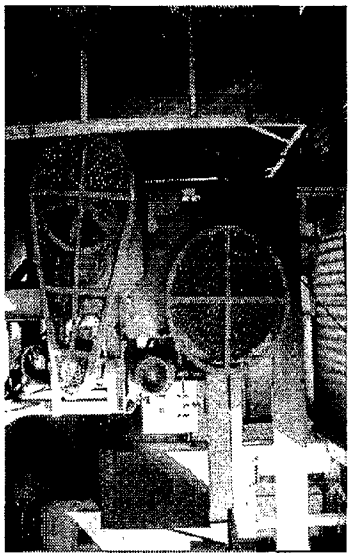
Figure 8B:
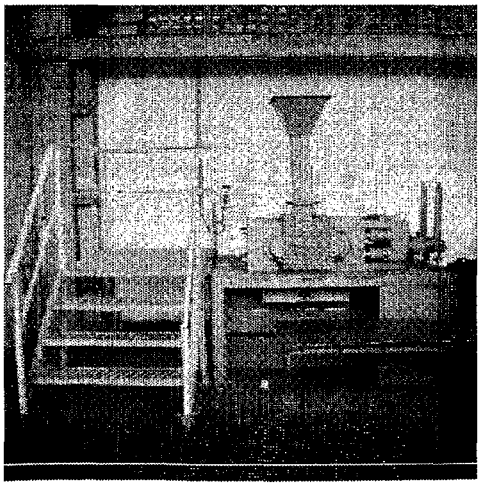
Figure 9:
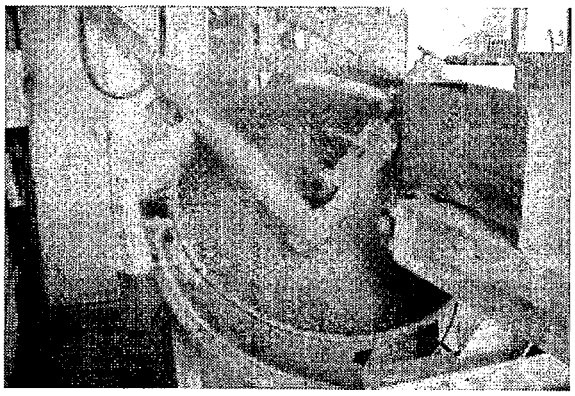
Figure 10:
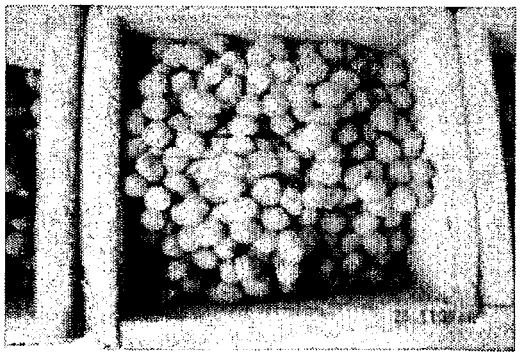
Figure 11:
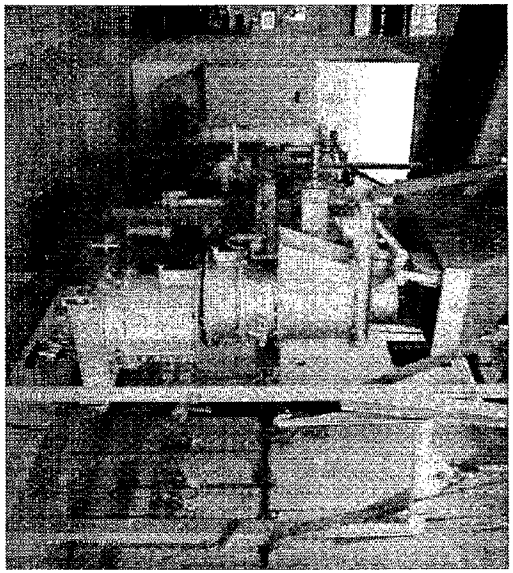
Figure 12:
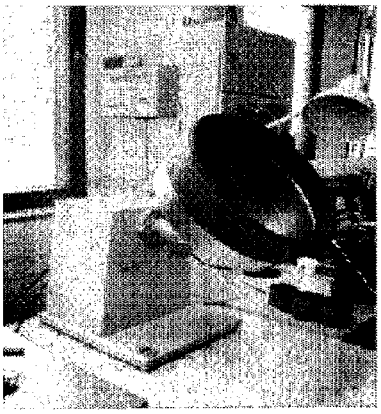
Figure 13A:
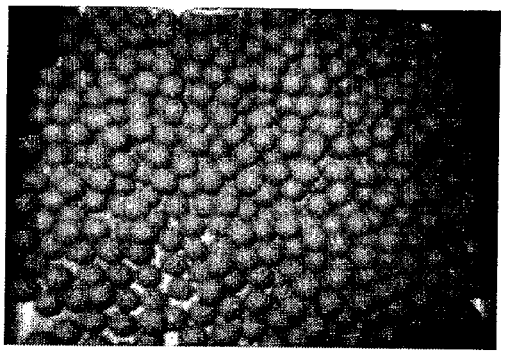
Figure 13B:
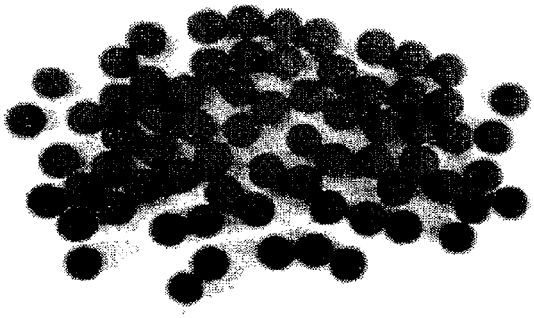
Figure 14:
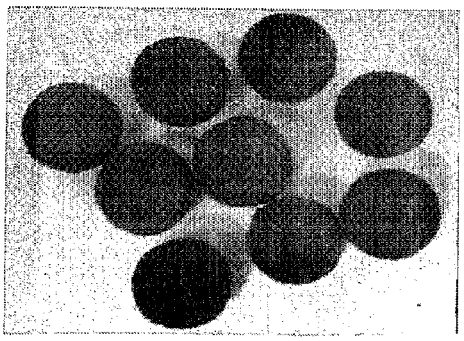
Figure 15:
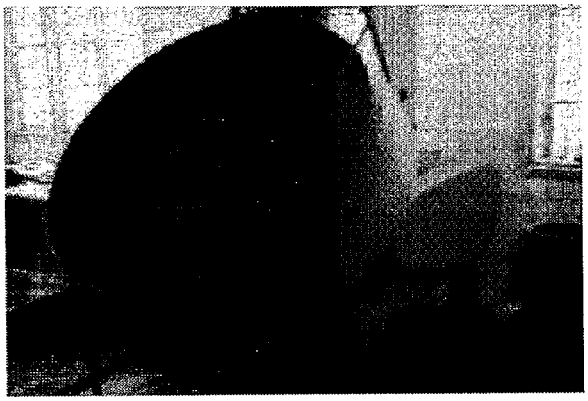
Figure 16:
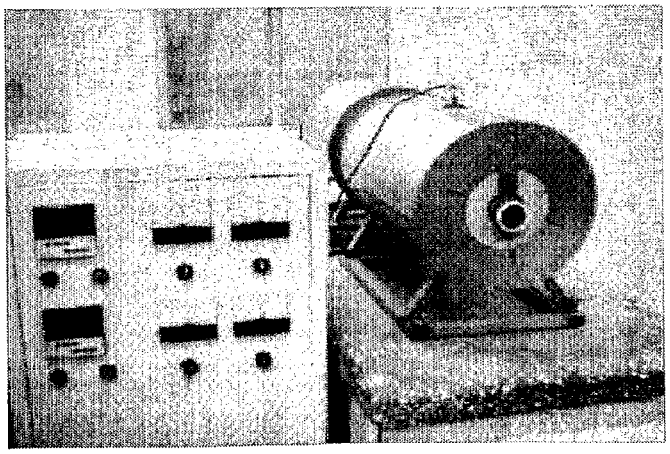

FIGS. 8A and 8B—show the comminution equipment used in the process, object of this invention;

FIG. 9—shows a pelletizing disk used in the simulated "traveling grate" process;

FIG. 10—shows crude pellets used in the simulated "traveling grate" process;

FIG. 11—shows the Pot-Grade burning furnace used in the simulated "traveling grate" process;

FIG. 12—shows a 400 mm diameter lab disk used in the pelletizing test for the simulated "steel belt" process;

FIGS. 13A and 13B—show moisturized and dry pellets used in the simulated "steel belt" process;

FIG. 14—shows 1300° C. sintered pellets from the simulated "steel belt" process;

FIG. 15—shows a pelletizing disk used in the fabrication of crude pellets in the simulated "grate kiln" process; and FIG. 16—shows the burning furnace used in the simulated "grate kiln" process.

DETAILED DESCRIPTION OF THE INVENTION

Pelletizing is a mechanical and thermal agglomerating process to convert the ore's ultrafine fraction into spheres of about 8 to 18 mm size with suitable characteristics for reduction furnaces feed.

The present invention allows for the production of pellets from manganese ores without previous calcination and with a 40 to 60% passing size through a 0.044 mm mesh (coarser material).

Manganese ore pellet production based on this present invention's process complies with the following phases:

1) Manganese ore drying;

2) Ore size preparation through comminution process;

3) Addition of fluxes (calcite or dolomite limestone or other MgO sources such as serpentinite, olivine, etc.) to manganese ore;

4) Addition of agglomerant to the manganese and flux ore mixture;

5) Mixture of the resulting material from previous phase;

6) Final mixture pelletizing for the production of manganese ore crude pellets;

7) Crude pellet screening;

8) Managanese ore pellet burning;

9) Burnt pellet screening; and

10) Stocking and shipping of manganese ore pellet.

This process applies to a more oxide manganese ore as well as to ores from other same-type metals with specific size distribution, specific surface varying from 800 to 2000 $cm^2/g$ and percent smaller than 0.044 mm from 40 to 60%. The ore shall be prepared in such a way as to prevent the generation of ultrafine material.

As far as the ore preparation process is concerned, the selected equipment depends on the ore's initial size. During this phase no ball milling shall be used for the material's particle size reduction. The most suitable equipment for the comminution process is: crusher and roller press or only a roller press with or without recirculation. In the case of ore fraction greater than 0.5 or 1.0 mm mesh particles size shall be previously reduced so as to obtain 100% of the passing material through this mesh to be then submitted to the roller pressing process with and without recirculation. Materials with a fraction smaller than 0.5 or 1.0 mm can be roller press processed with and without recirculation. There must be enough pressing until a specific surface ranging from 800 to 2000 $cm^2/g$ and/or a size from 40 to 60% is attained for the 0.044 mm mesh passing material. In the case of finer size ore, that is, those at the specific surface range and with mesh 0.044 mm passing percent, at the range or greater than 40%, crushing and pressing phases can be disregarded.

Crushing and/or roller press phases shall occur in a closed circuit with screen to ensure the desired product size from such operations.

The use of roller press with and without recirculation requires previous ore drying, the initial moisture of which is around 12 to 15% against final moisture between 9 and 10%. Drying shall be preferably performed in a solid or liquid fuel powered rotary dryer aimed at power generation.

Following through the pelletizing process, after the manganese ore size preparation, the comminuted material shall be mixed with flux, either calcite or dolomite limestone or any other MgO source such as serpentinite, olivine, etc.

Flux dosage can vary from 0.1 to 2.0% by function of the desired chemical composition for the pellet. Then the mixture receives the agglomerant dosage, which can be bentonite (from 0.5 to 2.0%), hydrate lime (2.0 to 3.0%) or CMC-type synthetic agglomerant, Carboximetilcelulose (from 0.05 to 0.10%). Quantities shall be suitable for the formation of crude pellets with enough resistance to support the transportation up to the furnace and thermal shocks to which they shall be subject during drying, pre-burning and burning phases. Both moisturized and dry pellets resistance shall be at least 1.0 and 2.0 kg/pellet, respectively, with a minimal resilience value, that is, 5 (five) drops.

Water dosage is performed during the pelletizing phase, either by disk or drum. The addition shall be by function of the mixture initial moisture in quantities enough to allow for the formation of good physical quality crude pellet. Depending on the size and agllomerant addition, moisture can vary from 14 to 18%.

Crude pellets shall be heat processed in a "traveling grate", "grate kiln" or a steel belt-type furnace, depending mainly on the desired production volume. Due to thermal shock special attention shall be given to pellet's both drying and pre-burning phases. The heating ratio shall vary from 50 to 150° C./minute. Maximum temperature and total burning time shall be such as to ensure final product's quality in terms of physical resistance, mainly compression resistance. Top maximum temperature can vary from 1280 to 1340° C. and total time from 34 to 42 minutes. Pellet's compression resistance shall be at least 250 daN/pellet.

In order to better explain the invention examples of pelletizing and burning are given hereinafter but these should not be taken for limitative effects of the invention. The mixture composition for pelletizing and the ore preparation route for all examples are presented in FIG. 5.

The calcite limestone was added as a flux and CaO source for the formation and composition adjustment of slag in the electrical furnace (FEA), and was prepared so as to have 70% of the material passing in a 325 mesh.

Bentonite was added as agglomerant and flux for the pelletizing process. Managanese and $SiO_2$ make a compound, the fusion point of which being on the order of 1.274° C.

PHOTOS 1A and 1B show comminution equipment used for the invention: mill (A) and roller press, bench/pilot (B), used for the comminution of ores and fluxes.

Example 1

Pelletizing and Pilot Scale Manganese Ore Burning—"Traveling Grate" Process

Raw materials used in the study were manganese ore called MF15 from Mina do Azul (Carajás/PA), Northen calcite limestone and bentonite from India. TABLE 4 shows the chemical analyses of the materials used:

TABLE 4

Chemical analyses of raw materials

| Materials | Fe | Mn | $SiO_2$ | $Al_2O_3$ | CaO | MgO | P | PPC |
|---|---|---|---|---|---|---|---|---|
| SFMn - MF15 | 4.74 | 44.20 | 3.72 | 8.12 | 0.18 | 0.23 | 0.080 | 15.36 |
| Calcite limestone | ND | 0.020 | 2.15 | 0.89 | 51.93 | 1.25 | 0.068 | 42.22 |
| Bentonite Ashapura | ND | ND | 63.50 | 16.12 | 1.30 | 2.98 | 0.020 | 6.50 |

A speed-adjustable belt feeder, a 1 (one) meter diameter pelletizing disk, 45° angle, 19 rpm speed and a water spray-based dosage system were used during the crude pellet production phase (PHOTO 2)

At times the disk angle was altered (from 45° to 43°) so as to allow for pellets to reach diameters ranging from 10 to 20 mm by function of longer residence time. The purpose of this activity was to ensure that, following the burning phase, pellets would be kept within the range of 8 to 18 mm by function of ore contraction due to dehydration, which was observed in bench scale tests, during the burning and crude pellet calcination phases.

For the purpose of characterizing crude pellets as shown in PHOTO 3, moisturized and dry crude pellets were subjected to compression resistance and number of drops assays (resilience), assays used to evaluate the performance of crude pellets while simulating handling phases during classification (crude pellet screening), haulage and transference to the burning furnace. The results are shown in TABLE 5 as follows:

TABLE 5

Crude pellet physical quality.

| Resistance to compression (kg/p) | | |
|---|---|---|
| Moisturized | Dry | Number of drops |
| 1.15 | 8.49 | 90.73 |

Following the production of crude pellets, they were screened by 8, 10, 12.5, 16, 18, and 20 mm mesh for size distribution evaluation.

The 10-mm mesh passing materials and the ones retained on 20 mm mesh were discarded while materials within the range of 10 to 20 mm were mixed for the formation of crude pellet load to be heat processed in a Pot Grate-type pilot furnace.

FIG. 6 and PHOTO 4 show a schematic drawing where remissive figures stand for, respectively, (3) top; (4) middle; (5) bottom; (6) lining, and the figures indicate (1) lining layer (10 cm) and (2) side layer (2 cm) and the pellet burning furnace photo. The following are data relative to such equipment:

Pot-Grate Burning Furnace:

| | |
|---|---|
| Internal diameter | 30 cm |
| External diameter | 40 cm |
| Height | 50 cm |
| Refractory lining | plates of silica-luminous material |
| Lining layer height | 10 cm |

-continued

| | |
|---|---|
| Air pressure | variable |
| Air flow | variable |
| Temperature range | 0° C. to 1.350° C. |

For the assembly of the Pot Grate, burnt ore pellets were used as lining layer, being protected by a grate/steel screen and for the side layer 6 mm porcelain spheres were used.

After being fed with crude pellets, the furnace was sealed and the thermocouples were connected. The burning was scheduled during furnace load, specifying the thermal profile to be executed so that crude pellets can go through upstream drying, downstream drying, pre-heating, heating, post-heating and cooling off without the generation of pellet degrading fractures.

Upon completion of the cooling phase, burnt pellets were then unloaded, separated from the porcelain spheres, homogenized, quartered, and sent for compression and abrasion resistance physical assays and chemical analysis.

Burnt pellets were then subjected to lab chemical analyses as shown in TABLE 6 as follows:

TABLE 6

Burnt pellet chemical composition.

| Mn | $SiO_2$ | CaO | Fe | $Al_2O_3$ | Comp. Resist. | Abrasion Resist. |
|---|---|---|---|---|---|---|
| 41.00 | 5.92 | 2.43 | 5.71 | 9.26 | 250 daN/pellet | 3.0% < 0.5 mm Max |

The evaluated burnt pellet physical quality parameters were Resistance to Compression (RC), the result of which being 269 daN/pellet, and the Abrasion Index (AI), with 1.4% passing through a 0.5 mm mesh.

Norms and ISO (International Standardization for Organizations) methodologies for iron ores were used to conduct the manganese pellet quality evaluation assays.

Example 2

Pelletizing and Bench Scale Manganese Ore Burning—"Steel Belt" Process

Manganese ore fines chemical analyses were performed using mainly chemical to moisture methods, FAAS (atomic absorption), ICP (plasma), and a sulfur-carbon Leco analyzer. Heat loss was measured in an atmosphere of N2 to 1100° C.

TABLE 7 shows the chemical analysis.

TABLE 7

Mn ore chemical composition.

| | Component | | | | | | | | | | | |
|---|---|---|---|---|---|---|---|---|---|---|---|---|
| | Mn | Fe | $SiO_2$ | CaO | MgO | $Al_2O_3$ | K | Na | S | C | L.O.I[1)] | $H_2O$ |
| % | 43.1 | 6.1 | 4.5 | 0.27 | 0.36 | 9.0 | 0.89 | <0.04 | 0.12 | 0.17 | 16.5 | 8.2 |

[1)]Heat loss

Calcite was used in tests as flux, the composition of which being as follows: heat loss of 49.6% CaO and 43.0%

The pelletizing test was performed in a 400 mm lab disk (PHOTO 5). The mixture for the pelletizing comprised manganese ore fines, calcite and bentonite, which were initially manually mixed and lately using a lab V mixer for 60 minutes. The mixed portion was manually fed into the disk. As the mixture was fed into the disk water is spray-controlled for the formation of pellets. The mean desired pellet diameter was 12 mm. Following the pelletizing test, moisturized and dry pellets diameters and compression resistance were then measured and the humidity of moisturized pellets was calculated.

An induction furnace (FIG. 7) was used for sintering tests. Pellets were transported in a 110 ml alumina crucible, which was placed inside a bigger graphite crucible, with the set being placed into an induction furnace. The graphite crucible was previously lidded and air was injected into the test crucible with the system temperature being continuously measured. Pellets were then lab-scale heated in accordance with the desired temperature profile. The compression resistance target was 200 kg/pellet (suitable for a 12 mm size). FIG. 8 shows these temperatures.

Pelletizing tests results are shown in TABLE 8 and the photos of moisturized and dry pellets are shown in PHOTOS 6A and 6B.

TABLE 8

Crude pellet physical quality.

| | Resistance (kg/pellet) | |
|---|---|---|
| Moisture (%) | Moisturized | Dry |
| 14.8 | 1.46 | 7.78 |

In the sintering test, pellets were heated pursuant to defined temperature profiles aimed at a lab scale description of the sintering in the metallic conveyor. Actual sintering conditions shall be researched by means of a pilot bench scale test during an upcoming phase. A targeted compression resistance of 200 kg/pellet (12 mm diameter pellet) was obtained at 1300° C. Compression resistance reached 300 kg/pellet at 1350° C. PHOTO 7 shows pictures of sintered pellets at 1300° C.

Example 3

Bench Scale Manganese Ores Pelletizing and Burning—"Grate Kiln" Process

Chemical compositions of both manganese ore and input used for this study are shown in TABLES 9 through 11.

TABLE 9

Manganese ore chemical quality.

| | Element | | | | | | | | |
|---|---|---|---|---|---|---|---|---|---|
| | $Fe_{total}$ | FeO | $Fe_2O_3$ | $Mn_{total}$ | MnO | $MnO_2$ | $SiO_2$ | $Al_2O_3$ | CaO |
| % | 6.49 | 1.87 | 7.21 | 42.73 | 1.52 | 65.75 | 5.79 | 7.24 | 1.12 |

| | Element | | | | | |
|---|---|---|---|---|---|---|
| | MgO | $K_2O$ | $Na_2O$ | P | S | LOI |
| % | 0.26 | 1.19 | 0.042 | 0.093 | 0.035 | 6.82 |

TABLE 10

Bentonite chemical quality.

| | Element | | | | | | | | | | |
|---|---|---|---|---|---|---|---|---|---|---|---|
| | $Fe_{total}$ | $Fe_2O_3$ | $SiO_2$ | $Al_2O_3$ | CaO | MgO | $K_2O$ | $Na_2O$ | P | S | LOI |
| % | 9.10 | 13.01 | 50.97 | 17.32 | 2.89 | 0.26 | 0.16 | 2.52 | 0.053 | 0.035 | 11.91 |

TABLE 11

Calcite limestone chemical quality.

| | Element | | | | | | |
|---|---|---|---|---|---|---|---|
| | $Fe_{total}$ | $Fe_2O_3$ | $SiO_2$ | $Al_2O_3$ | CaO | MgO | LOI |
| Grade | 0.17 | 0.24 | 0.65 | 0.22 | 54.89 | 0.26 | 43.32 |

Crude pellets made in pelletizing disks (PHOTO 8) using manganese ore mixtures, limestone and bentonite, as well as the effect of diverse parameters over the quality of crude pellets were evaluated. The process parameters observed in this evaluation phase are as follows:

Pelletizing conditions: pelletizing time and compaction;

Bentonite dosage;

Limestone size;

Coal dosage.

TABLES 12 through 14 show the results of these evaluations:

TABLE 12

Effects of pelletizing time and compaction and bentonite dosage over crude pellet quality.

| Pelletizing conditions | | | | Moisturized compression | Thermal shock | |
|---|---|---|---|---|---|---|
| Pelletizing time/min | Compaction time/min | Bentonite/ % | Number of drops | resistance/ N/pellet | Temp./ ° C. | Moisture/ % |
| 12 | 2 | 1.5 | 59.9 | 13.74 | 540 | 15.72 |
| 12 | 0 | 1.5 | 51.1 | 10.01 | 520 | 15.80 |
| 7 | 2 | 1.5 | 9.7 | 9.50 | 449 | 16.61 |

TABLE 13

Basicity effects over crude pellet quality.

| Basicity/ $CaO/SiO_2$ | Number of drops | Moisturized compression resistance/ N/pellet | Thermal shock Temp./° C. |
|---|---|---|---|
| 0.18 (natural basicity) | 9.7 | 9.50 | 449 |
| 0.30 | 10.9 | 13.48 | 270 |
| 0.50 | 9.1 | 14.03 | 261 |
| 0.70 | 13.6 | 16.39 | 260 |
| 0.90 | 13.8 | 12.14 | 225 |
| 1.10 | 19.6 | 14.85 | 206 |

TABLE 14

Effects of coal addition over crude pellet quality.

| Coal addition % | Number of drops | Moisturized compression resistance/ N/pellet | Thermal shock Temp../° C. |
|---|---|---|---|
| 0 | 13.8 | 12.14 | 225 |
| 0.5 | 13.0 | 10.29 | 368 |
| 1.0 | 11.2 | 8.60 | 345 |

Based on such results we can conclude that:

Most suitable pelletizing parameters should be the bentonite addition between 1.4 and 1.5%, moisture between 14 and 15% and pelletizing time on the order of 12 minutes. Under such conditions, drops totaled 50, and the thermal shock temperature was greater than 400° C. while moisturized crude pellet compression resistance was greater than 10 N/pellet;

Increased basicity implied and increased number of drops and increased moisturized crude pellet resistance compression. A striking decrease was also observed in the thermal shock temperature. On the other hand, the increased addition of coal affected significantly moisturized crude pellet compression resistance.

Crude pellets were burnt in a vertical furnace (PHOTO 9) and during this phase the effects of the following parameters over burnt pellet resistance compression were evaluated:

Pre-heating, time and temperature conditions;

Heating, time and temperature conditions;

Binary basicity;

Coal addition.

TABLES 15 to 18 show the results of these evaluations:

TABLE 15

Effects of temperature and pre-heating time over burnt pellet quality

| Temperature | Time | Compression resistance (N) | |
|---|---|---|---|
| (° C.) | (min) | 1 | 2 |
| 1010 | 8 | 492 | 542 |
| 1010 | 10 | 577 | 594 |
| 1010 | 12 | 544 | 551 |
| 1010 | 15 | / | 549 |

1—Pelletizing and compaction time of 12 and 2 min, respectively, and normal heating ratio.

2—Pelletizing and compaction time of 7 and 2 min, respectively, and low heating ratio.

3—% < 0.044 mm = 60%.

TABLE 16

Effect of burning temperature over burnt pellet quality

| Temperature | Time | Compression resistance (N) | | |
|---|---|---|---|---|
| (° C.) | (min) | 1 | 2 | 3 |
| 1250 | 15 | / | 1140 | 1232 |
| 1280 | 15 | 1493 | / | / |
| 1300 | 15 | / | 1437 | 1190 |
| 1316 | 15 | 1513 | 1881 | 2088 |
| 1330 | 15 | / | / | / |
| 1337 | 15 | 2433 | 2567 | 2241 |

1—Pelletizing and compaction time of 12 and 2 min, respectively, and low heating ratio.
2—Pelletizing and compaction time of 7 and 2 min, respectively, and low heating ratio.
3—Pelletizing and compaction time of 7 min and low heating ratio.
4—% < 0.044 mm = 60%.

TABLE 17

Effect of burning time over burnt pellet quality.

| Temperature | Time | Compression resistance (N) | |
|---|---|---|---|
| (° C.) | (min) | 1 | 2 |
| 1337 | 12 | / | 1861 |
| 1337 | 15 | 2433 | 2567 |
| 1337 | 18 | / | 2530 |
| 1337 | 20 | 2338 | / |

1—Pelletizing and compaction time of 12 and 2 min, respectively, and low heating ratio.
2—Pelletizing and compaction time of 7 and 2 min, respectively, and low heating ratio.
3—% < 0.044 mm = 60%.

TABLE 18

| Effect of basicity over burnt pellet quality | | | | | | |
|---|---|---|---|---|---|---|
| Temperature | Time | Resistance to compression (N) | | | | |
| (° C.) | (min) | R0.3 | R0.5 | R0.7 | R0.9 | R1.1 |
| 1300 | 15 | 1120 | 1400 | 1438 | 1478 | / |
| 1320 | 15 | / | 1822 | 1853 | 2137 | 2235 |
| 1330 | 15 | / | / | / | 2167 | 2242 |
| 1337 | 15 | 2554 | 2799 | 2817 | 3136 | 3229 |
| 1337 | 12 | / | / | / | / | 2255 |

TABLE 19

| Effect of coal addition and pre-heating time over burnt pellet quality. | | | |
|---|---|---|---|
| Coal (%) | Pre-heating temperature (° C.) | Pre-heating time (min) | Compression resistance (N) |
| 0 | 1010 | 10 | 594 |
| 0.5 | 1000 | 10 | 241 |
| 0.5 | 1050 | 10 | 221 |
| 0.5 | 1100 | 10 | 260 |
| 1.0 | 1000 | 10 | 203 |
| 1.0 | 1050 | 10 | 178 |
| 1.0 | 1100 | 10 | 196 |

Based on such results we can conclude that:

(1) Crude pellet pre-heating conditions are very important for the production of good quality pre-heated pellets. When crude pellets were produced with ore 60% smaller than 0.044 mm, 1.5% bentonite, pelletizing time of 7 min and 2 min for compaction, temperature and pre-heating time of 1010° C. and 10 min, respectively, it was possible to produce pre-heated pellets with 600N compression resistance.

(2) Burnt pellet compression resistance reached 600N during pre-heating and 2600N during heating, where temperature and processing time were 1010° C. and 10 min, during pre-heating, and 1337° C. and 15 min during heating;

(3) Burnt pellet compression resistance can be drastically improved with the addition of calcite limestone, with basicity varying between 0.3 to 1.1 during heating conditions mentioned in item 2.

(4) The addition of coal affects negatively burnt pellet compression resistance.

The invention claimed is:

1. A process to produce manganese pellets from non-calcinated manganese ore comprising:

ore size preparation through ore classification by particle size smaller or equal to 1 mm particles and comminution of the particles;

flux addition;

agglomerant addition, wherein the agglomerant is selected from a group consisting of bentonite at 0.5% to 2.0% by mass, hydrated lime at 2.0% to 3.0% by mass, carboximetilcelulose (CMC) at 0.05% to 0.1% by mass, and mixtures thereof;

pelletizing resulting in crude pellets; and thermal processing through drying, pre-heating and heating the crude pellets.

2. The process according to claim 1, wherein an ore drying phase occurs before the ore size preparation phase to dry the ore to a maximum moisture of 9% by mass.

3. The process according to claim 1, wherein the comminution comprises crushing and pressing operations.

4. The process according to claim 3, wherein during the ore size preparation, a fraction of manganese ore with particle size greater than or equal to 1.0 mm is handled with a roller press.

5. The process according to claim 1, wherein the ore size preparation results in ore particles comprising a specific surface area between 800 to 2000 $cm^2/g$.

6. The process according to claim 1, wherein the ore size preparation results in 40 to 60% by mass of ore particles having a size smaller than 0.044 mm.

7. The process according to claim 1, wherein the flux addition comprises adding calcite limestone, dolomite limestone, mixtures of calcite and dolomite limestone, or other magnesium oxide source.

8. The process according to claim 1, wherein the crude pellets have a minimal resistance of 1 and 2 kg/pellet and a resilience of at least 5 drops.

9. The process according to claim 1, wherein the thermal processing comprises passing the crude pellets through a traveling grate, grate kiln or steel belt-type furnace.

10. The process according to claim 9, wherein the thermal processing is at a maximum temperature of 1280 to 1340° C.

11. The process according to claim 9, wherein the thermal processing has a total time ranging from 34 to 42 minutes.

12. An iron-manganese agglomerate obtained through the process of claim 1, wherein the iron-manganese agglomerate comprises an average diameter between 8 and 18 mm, and wherein the iron-manganese agglomerate comprises a minimal compression resistance of 250 daN/acclomerate.

13. A process for producing manganese pellets from non-calcinated manganese ore comprising:

ore size preparation through ore classification by particle size smaller or equal to 1 mm particles and comminution of the particles, wherein the ore size preparation results in 40 to 60% by mass of ore particles comprising a size smaller than 0.044 mm;

flux addition;

agglomerant addition of bentonite at 0.5% to 2.0% by mass;

pelletizing resulting in crude pellets; and thermal processing through drying, pre-heating and heating the crude pellets.

* * * * *